US008973794B2

(12) United States Patent
Bergkvist et al.

(10) Patent No.: US 8,973,794 B2
(45) Date of Patent: Mar. 10, 2015

(54) BABY CARRIER

(75) Inventors: Håkan Bergkvist, Bromma (SE); Andreas Zandren, Tyreso (SE); David Thalen, Bromma (SE)

(73) Assignee: Babybjorn AB, Solna (SE)

( * ) Notice: Subject to any disclaimer, the term of this patent is extended or adjusted under 35 U.S.C. 154(b) by 424 days.

(21) Appl. No.: 13/034,028

(22) Filed: Feb. 24, 2011

(65) Prior Publication Data

US 2012/0187162 A1 Jul. 26, 2012

(30) Foreign Application Priority Data

Jan. 25, 2011 (SE) ..... 1150048

(51) Int. Cl.
*A47D 13/02* (2006.01)

(52) U.S. Cl.
CPC ..... *A47D 13/025* (2013.01)
USPC ..... 224/160; 224/159

(58) Field of Classification Search
CPC ..... A47D 13/02
USPC ..... 224/159–161
See application file for complete search history.

(56) References Cited

U.S. PATENT DOCUMENTS

| | | | | |
|---|---|---|---|---|
| 4,402,440 | A * | 9/1983 | Purtzer et al. | 224/160 |
| 2005/0045674 | A1* | 3/2005 | Rehbein | 224/160 |
| 2006/0048721 | A1* | 3/2006 | Bergkvist | 119/770 |
| 2009/0026235 | A1* | 1/2009 | Gray | 224/160 |
| 2010/0072236 | A1* | 3/2010 | Parness et al. | 224/161 |
| 2010/0108727 | A1* | 5/2010 | Lundh | 224/160 |

FOREIGN PATENT DOCUMENTS

WO WO 03/003880 A1 1/2003

* cited by examiner

*Primary Examiner* — Brian D Nash
*Assistant Examiner* — Corey Skurdal
(74) *Attorney, Agent, or Firm* — Jacobson Holman, PLLC.

(57) ABSTRACT

A baby carrier has two strap loops, which are interconnected and arranged to extend around the two shoulder areas of the wearer, with each strap loop having a first part and a second part. A carrying pocket is mounted to the strap loops and has a front piece at the strap loop, and a seat part is adjustably attached to the respective strap loop by a lower connection device. A first part of the respective strap loop is connected with the lower connection device. The second part of the respective strap loop is connected with the first part on a level with an upper second connection device. Regulation of the size of the baby carrier according to the child's length is solely carried out by regulating the seat part so that the lower second connection device is always situated immediately below the child's arms.

6 Claims, 3 Drawing Sheets

BABY CARRIER

FIELD OF THE INVENTION

The invention relates to a baby carrier that includes in general two strap loops, a carrying pocket, and a seat part.

BACKGROUND OF THE INVENTION

Thus the baby carrier is of the type that comprises two strap loops, which are interconnected and arranged to extend around the two shoulder areas of the wearer and each one of which comprises a first part and a second part, and a carrying pocket that is mounted to the strap loops and has a front piece having at least one free side edge that can be attached to an adjacent strap loop by means of at least one upper first and one upper second connection device for the carrying of the front piece at the strap loop, and a seat part that can be adjustably attached to the respective strap loop by means of a lower connection device, the front piece and the respective strap loop below the upper second connection device defining a leg opening for a child sitting in the baby carrier, besides which the first part of at least one strap loop is detachably connected with the lower connection device.

It is desirable to be able to utilize one and the same baby carrier from the child being newborn until it weighs approx. 12 kg. This is on account of the fact that a child increases its own weight approx. 3 times and becomes approx. 30% longer during its first year of life.

In order to allow comfortable carrying of a heavier one, it is common to provide a baby carrier with a relief belt that extends around the waist of the wearer for relieving the pressure on the shoulders of the wearer to as great an extent as possible.

By providing the baby carrier with a relief belt, it is also achieved that the seat part and thereby the child's legs and behind come closer to the wearer, the child's centre of gravity being moved closer to the wearer and it becoming easier and safer to carry the child.

Further, it is very important that a newborn child is kept in an upright position in the baby carrier in order to keep the airways free as well as to guarantee that the back is kept in a correct position.

Thus, it would be desirable to provide a baby carrier that allows at least the child's chest- or back portion to be moved/become placed closer to the wearer, when the child is carried, than what is allowed in conventional baby carriers of the above-mentioned type with or without a relief belt. More precisely, it would be desirable to provide a strain over the child's back against the wearer, when it is sitting in the baby carrier with the face facing the wearer, or over its chest, when it is sitting with the face turned from the wearer, in order to, in such a way, guarantee that the child is kept in the correct position. If no such strain over a small child's back/chest is present, there is a risk that the child slides down in the baby carrier, wherein there is a danger of the child's airways being blocked.

Further, in case of a newborn child, it is very important that the strain that should keep the child upright occurs in the correct position in relation to the child's back/chest, and more precisely on a level with just below the child's arms. The strain has preferably the form of an area over the child's back/chest.

In this connection, it should be mentioned that, in case of a baby carrier of the above-mentioned type, a child up to four months of age should not sit in the carrier with the face turned from the wearer because of the fact that the child cannot carry its head in a stable way but the head needs to be supported by means of the upper border portion of the front piece.

In order to allow the strain to become placed in the right spot as the child grows, at least the seat part of the baby carrier has to be adjustable. There is otherwise a risk of, in case of a small child, the strain occurring too high up on the child's body, and in case of a greater child too far down.

SUMMARY OF THE INVENTION

Thus, the object of the invention is to provide a baby carrier by which the above-mentioned disadvantages are at least partly eliminated.

This object is achieved by a baby carrier as described herein.

Preferred embodiments of the baby carrier are also described herein.

BRIEF DESCRIPTION OF THE DRAWINGS

The invention is described in more detail below in the form of non-limiting examples, reference being made to the appended drawings, in which.

DESCRIPTION OF PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

In the description and claims below, the baby carrier has been described in the case when the child is carried with the face facing the chest of the wearer, but it is evident that the child also can be carried with the face turned from the chest of the wearer.

Figure 1:
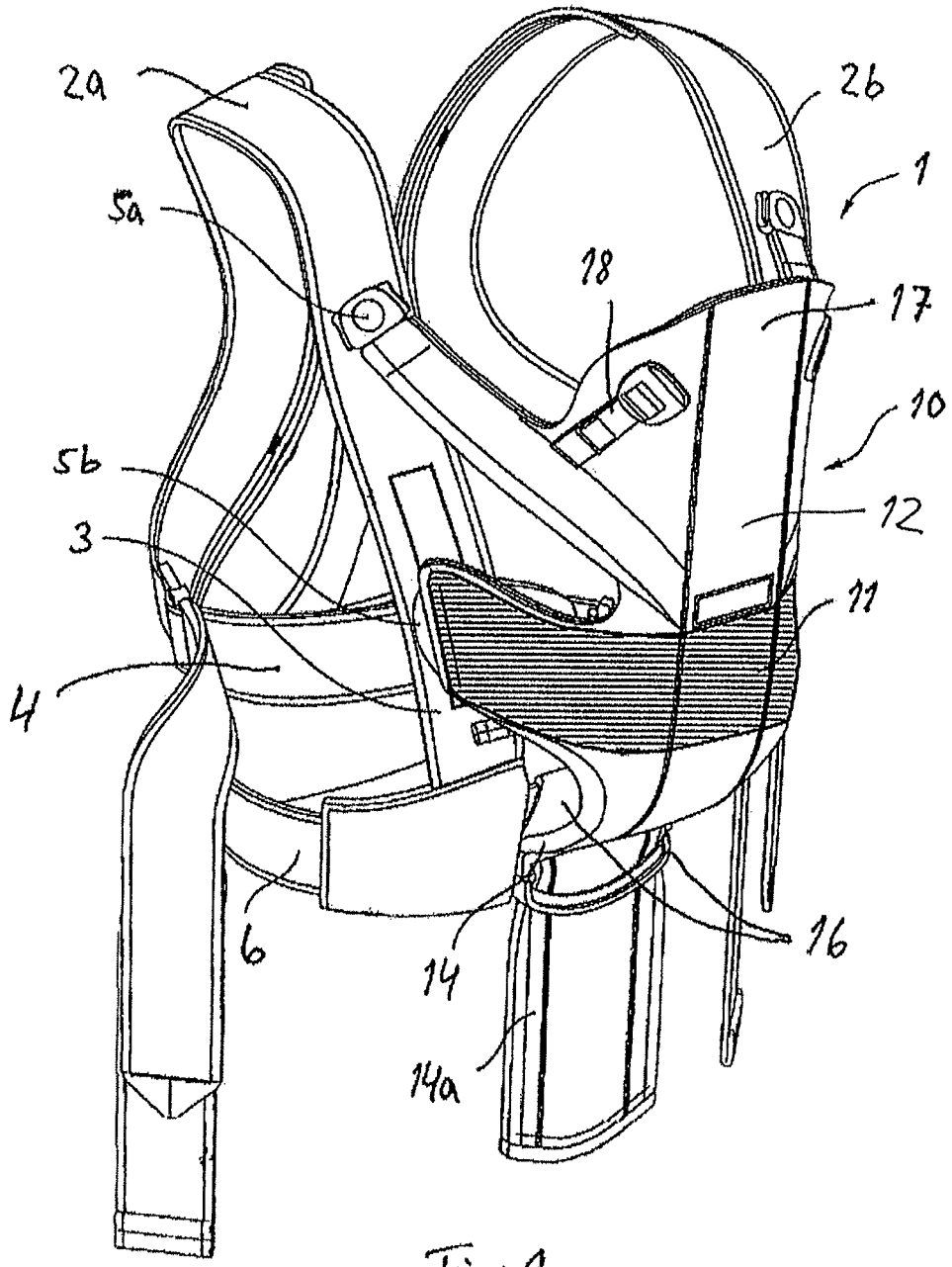
FIG. 1 is an overall view obliquely from the front of a baby carrier according to the invention.

As is seen in FIG. 1, a baby carrier 1 according to the invention comprises two adjustable strap loops 2*a*, 2*b*, which are interconnected and arranged to extend around the two shoulder areas of the wearer. Each one of the strap loops comprises a first part/end portion 3 and as second part/end portion 4. A carrying pocket 10 is mounted to the strap loops, which carrying pocket has front piece 12 having at least one free side edge that can be attached to an adjacent strap loop by means of at least one upper first and one upper second connection device 5*a*, 5*b* for the carrying of the front piece 12 at the strap loop. Preferably, the carrying pocket is formed and attached to the respective strap loop in such a way that the arms of a child sitting in the baby carrier will be situated between the upper first and the upper second connection device. At least the front piece 12 is preferably manufactured from a padded, flexible fabric material. The carrying pocket has also a seat part 14 that can be adjustably attached to the respective strap loop 2*a*, 2*b* by means of a lower connection device 16. The front piece 12 and the respective strap loop below the upper second connection device 5*b* define a leg opening for a child sitting in the baby carrier. Further, the first part 3 of at least one strap loop is detachably connected with the lower connection device 16.

In a baby carrier of the type mentioned above, this allows the baby carrier to be put on and taken off in the form of a jacket.

The attachment of the front piece 12 to the upper first and upper second connection device 5*a*, 5*b* is made in a known way, and preferably in the same way as described in, e.g., WO 03/003880, and therefore it will not be described in more detail.

In a baby carrier of the above-mentioned type, the regulation of the size of the baby carrier is carried out according to the child's length solely by the regulation of the size/length of the seat part 14. More precisely, the seat part 14 comprises an elongate tongue 14*a* that is adjustably attached to the lower connection device 16, the regulation of the baby carrier, as the child grows, being carried out in such a way that the seat part 14 become larger by the extension of the same. For an optimum adjustment of the size of the baby carrier according to the child's length, this involves that the child's arms always should be situated above the upper second connection device 5*b*. However, it should be mentioned that the width of an upper border portion 17 arranged on the front piece 12 can be adjusted by means of adjustable buckles 18 of a known type.

Figure 2:
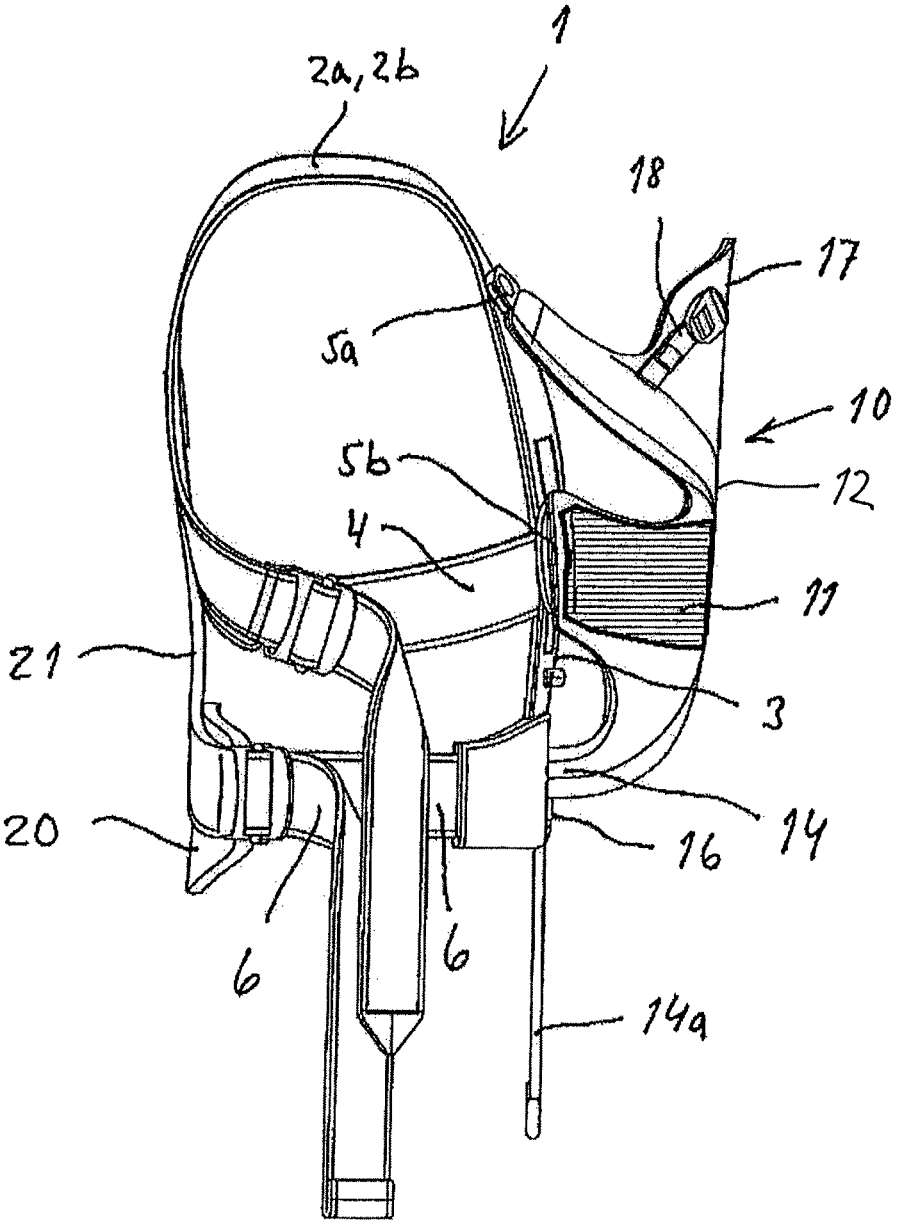
FIG. 2 is a side view of the baby carrier in FIG. 1.

In order to achieve that also at least the child's chest portion is moved/becomes placed closer to the wearer, when the child is carried, a second part 4 of the respective strap loop 2*a*,2*b* is connected with the first part 3 on a level with the upper second connection device 5*b*, and immediately below the child's arms. This entails that it, via the front piece 12, arises a strain under the arms and over the child's back portion toward the chest of the wearer. The strain that arises via the front piece 12 by connecting the second part 4 with the first part 3 in the above-mentioned way is shown schematically in FIGS. 1 and 2 by a ruled area 11. In this way, the carrying ergonomics is improved in that the child's centre of gravity is moved closer to the wearer as well as that the child is kept in an upright position, wherein the airways are kept free. Further, it is guaranteed that the child's back is kept in a correct position.

In case when one or both of the upper first connection devices 5*a* are loosened from the strap loop(s) for, e.g., lowering of the upper border portion 17, the child can lean back, but thanks to the second part 4 of the respective strap loop being attached to the first part 3 on a level with the upper second connection device 5*b*, this entails that no appreciable displacement of the child's centre of gravity from the wearer can occur as well as that there is not risk of the child falling out of the carrier if it would try to raise itself out of the same. This is guaranteed also by the size of the baby carrier being adjusted by the change of the length of the tongue 14*a* of the seat part 14 in relation to the lower connection device 16, which entails that the back, shoulders and head of the child always will be placed on approximately the same spot in relation to the front piece 12 independently of the child's length.

Further, the baby carrier may comprise a relief belt 6 that is adjustable in a suitable way and preferably extends around the waist of the wearer. The relief belt 6 is detachably connected, preferably via the lower connection device 16, with at least one of the first parts 3 of the respective strap loop on at least the chest side of the wearer, i.e., the relief belt does not have to be connected with the respective strap loop on the back side of the wearer.

Figure 1A:
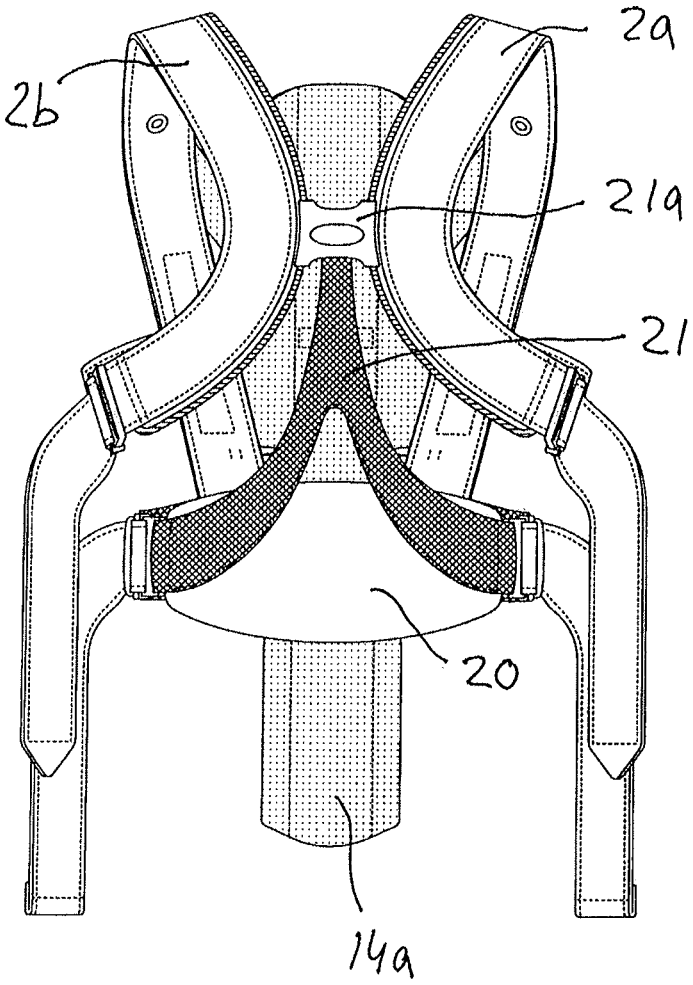
FIG. 1*a* is a view from the back of the baby carrier in FIG. 1.

In a preferred embodiment, the relief belt 6 comprises a back plate 20 that is vertically adjustably connected with the respective strap loop 2*a*,2*b* on the back side of the wearer via a stiff member 21 as seen in FIG. 1*a*. The stiff member 21 also adjustably interconnects the strap loops 2*a*, 2*b* via an adjustment means 21*a*. The adjustment means 21*a* is slidably attacked to respective edge of the strap loops facing each other. It is evident that a relief belt without a back plate can be adjustably connected with the respective strap loop on the back side of the wearer.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What claim is:

1. A baby carrier comprising:

two strap loops, which are separate elements for an entirety of their length and which are interconnected and arranged to extend around two shoulder areas of a wearer, each of the strap loops including a first part and a second part;

a carrying pocket that is mounted to the strap loops and that has a front piece having at least one free side edge that is attachable to an adjacent strap loop via at least one upper first and one upper second connection device for the carrying of the front piece at the strap loop; and a seat part that includes an elongated tongue, the seat. part being adjustably attached to the respective strap loop by a lower connection device, the front piece and the respective strap loop below the upper second connection device defining a leg opening for a. child sitting in the baby carrier, with a first part of at least one of the strap loops being detachably connected with the lower connection device, the second part of the respective strap loop being connected with the first part on a level with the upper second connection device, and a regulation of a size of the baby carrier according to a length of the child solely being carried out by the regulation of a length of the elongated tongue of the seat part so that the upper second connection device always is situated immediately below arms of the child.

2. The baby carrier according to claim 1, further comprising a relief belt that extends around a waist of he wearer, the relief belt being connected with at least one of the first parts of the respective strap loop on at least a chest side of the wearer.

3. The baby carrier according to claim 2, wherein the relief belt is adjustably connected with the respective strap loop on a back side of the wearer.

4. The baby carrier according to claim 3, wherein the adjustable connection of the relief belt with the respective strap loop on the back side of the wearer is provided by a stiff member.

5. A size-adjustable carrier for carrying a seated child, said carrier comprising:

first and second strap loops, which are separate elements for an entirety of their length and which are interconnected and arranged to extend around respective first, and second shoulder areas of a carrier wearer, each of the strap loops including a first part and a second part;

a carrying pocket that is mounted to the strap loops and that has a front piece having at least one free side edge that is attachable to an adjacent strap loop via at least one upper first and one upper second connection device for the carrying of the front piece at the strap loop; and a seat part having an elongated tongue, the seat part being adjustably attachable to the respective strap loop by a lower connection device, the front piece and the respective strap loop below the upper second connection device defining a leg opening for the seated child, with a first part of at least one of the strap loops being detachably connectable to the lower connection device, the second part of the respective strap loop being connected with the first part on a level with the upper second connection device, with adjustment of the size of the carrier being effected by adjusting a length of the elongated tongue of the seat part relative to the lower connection device such that the upper second connection device is located immediately below arms of the child.

6. The carrier according to claim 5, wherein during said adjustment of the size of the carrier, the seat part becomes larger in size as the length of the elongated tongue that extends below the seat part becomes smaller.

* * * * *